US012359885B1

(12) United States Patent
Head

(10) Patent No.: US 12,359,885 B1
(45) Date of Patent: Jul. 15, 2025

(54) FIREARM MAGAZINE CLAMPING ASSEMBLIES AND LOADER ASSEMBLIES

(71) Applicant: Vulcan Ballistic Products, LLC, Greenville, SC (US)

(72) Inventor: Thomas S. Head, Greenville, SC (US)

(73) Assignee: Vulcan Ballistic Products, LLC, Greenville, SC (US)

( * ) Notice: Subject to any disclaimer, the term of this patent is extended or adjusted under 35 U.S.C. 154(b) by 0 days.

(21) Appl. No.: 18/596,047

(22) Filed: Mar. 5, 2024

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
See application file for complete search history.

(56) References Cited

U.S. PATENT DOCUMENTS

| | | | | |
|---|---|---|---|---|
| 5,129,173 | A * | 7/1992 | Kuykendall | F41A 9/83 42/87 |
| 11,187,480 | B1 * | 11/2021 | Anderson | F41A 9/83 |
| 2022/0003513 | A1 * | 1/2022 | Sredl | F41A 9/83 |
| 2023/0358492 | A1 * | 11/2023 | Tippmann, Jr. | F41A 9/83 |

* cited by examiner

*Primary Examiner* — J. Woodrow Eldred
(74) *Attorney, Agent, or Firm* — Dority & Manning, P.A.

(57) ABSTRACT

A clamping assembly for clutching a firearm magazine during loading of a cartridge into the firearm magazine includes a main frame having a back stop portion, a first side portion, and a second side portion; a first side plate; and a second side plate. The clamping assembly further includes a first connection plate disposed between the first side plate and the first side portion of the main frame and pivotably coupled to both the main frame and the first side plate. The clamping assembly further includes a second connection plate disposed between the second side plate and second side portion of the main frame and pivotably coupled to both the main frame and the second side plate.

19 Claims, 11 Drawing Sheets

FIREARM MAGAZINE CLAMPING ASSEMBLIES AND LOADER ASSEMBLIES

FIELD

The present disclosure relates generally to clamping assemblies and loader assemblies. In particular, the present disclosure relates to clamping assemblies and loader assemblies that facilitate the loading of cartridges into a firearm magazine.

BACKGROUND

Many repeating firearms, such as pistols, submachine guns, assault rifles, and others, utilize magazines (often referred to as a clip) to store and feed cartridges (or bullets) into the firearm. A popular type of magazine in modern rifles and handguns is the box magazine, which stores cartridges in either a singular column or double column (also referred to as a zig-zag stack). Typically, box magazines are detachable and function to move the cartridges stored within the magazine into a position where they can be loaded into a barrel chamber by the action of the firearm. For example, box magazines are often slidably received within a slot in the firearm, usually below the action but occasionally to the side or on top. Typical box magazines are self-contained mechanisms capable of being loaded and unloaded while detached from the host firearm.

Generally, cartridges are loaded into the box magazine one at a time and gradually compress a spring. The spring produces a force that guides the cartridges towards an opening in the magazine, in order to be fed into the chamber of the firearm. The force supplied by the spring can make loading cartridges into magazine increasingly difficult, especially when the magazine is approaching its carrying capacity and the spring force is at a near maximum. For example, operators having weaker hands or arthritis may not be able to load a magazine whatsoever. As such, an apparatus for loading a firearm magazine is desired in the art. In particular, an apparatus that reduces the difficulty of loading a firearm magazine is desired in the art.

BRIEF DESCRIPTION

Aspects and advantages of the clamping assemblies and loader assemblies in accordance with the present disclosure will be set forth in part in the following description, or may be obvious from the description, or may be learned through practice of the technology.

In accordance with one embodiment, a clamping assembly for clutching a firearm magazine during loading of a cartridge into the firearm magazine is provided. The clamping assembly includes a main frame having a back stop portion, a first side portion, and a second side portion; a first side plate; and a second side plate. The clamping assembly further includes a first connection plate disposed between the first side plate and the first side portion of the main frame and pivotably coupled to both the main frame and the first side plate. The clamping assembly further includes a second connection plate disposed between the second side plate and second side portion of the main frame and pivotably coupled to both the main frame and the second side plate.

In accordance with another embodiment, a loader assembly that facilitates loading a cartridge into a firearm magazine is provided. The loader assembly includes a cartridge member defining a cartridge slot that is sized to receive a plurality of cartridges; a plunger member movably coupled to the cartridge member; and a clamping assembly removably couplable to the cartridge member. The clamping assembly includes a main frame having a back stop portion, a first side portion, and a second side portion; a first side plate; and a second side plate. The clamping assembly further includes a first connection plate disposed between the first side plate and the first side portion of the main frame and pivotably coupled to both the main frame and the first side plate. The clamping assembly further includes a second connection plate disposed between the second side plate and second side portion of the main frame and pivotably coupled to both the main frame and the second side plate.

In accordance with another embodiment, a method of using a loader assembly to facilitate loading a cartridge into a firearm magazine is provided. The method includes positioning a clamping assembly of the loader assembly such that a main frame of the clamping assembly contacts the firearm magazine. The method further includes pivoting a first connection plate and a first side plate relative to one another and relative to the main frame; and pivoting a second connection plate and a second side plate relative to one another and relative to the main frame. The method further includes sliding a plunger member within a slot of a cartridge member connected to the clamping assembly, the plunger member contacting the cartridge within the slot.

These and other features, aspects and advantages of the present clamping assemblies and loader assemblies will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present clamping assemblies and loader assemblies, including the best mode of making and using the present systems and methods, directed to one of ordinary skill in the art, is set forth in the specification, which makes reference to the appended figures, in which.

DETAILED DESCRIPTION

Figure 1:
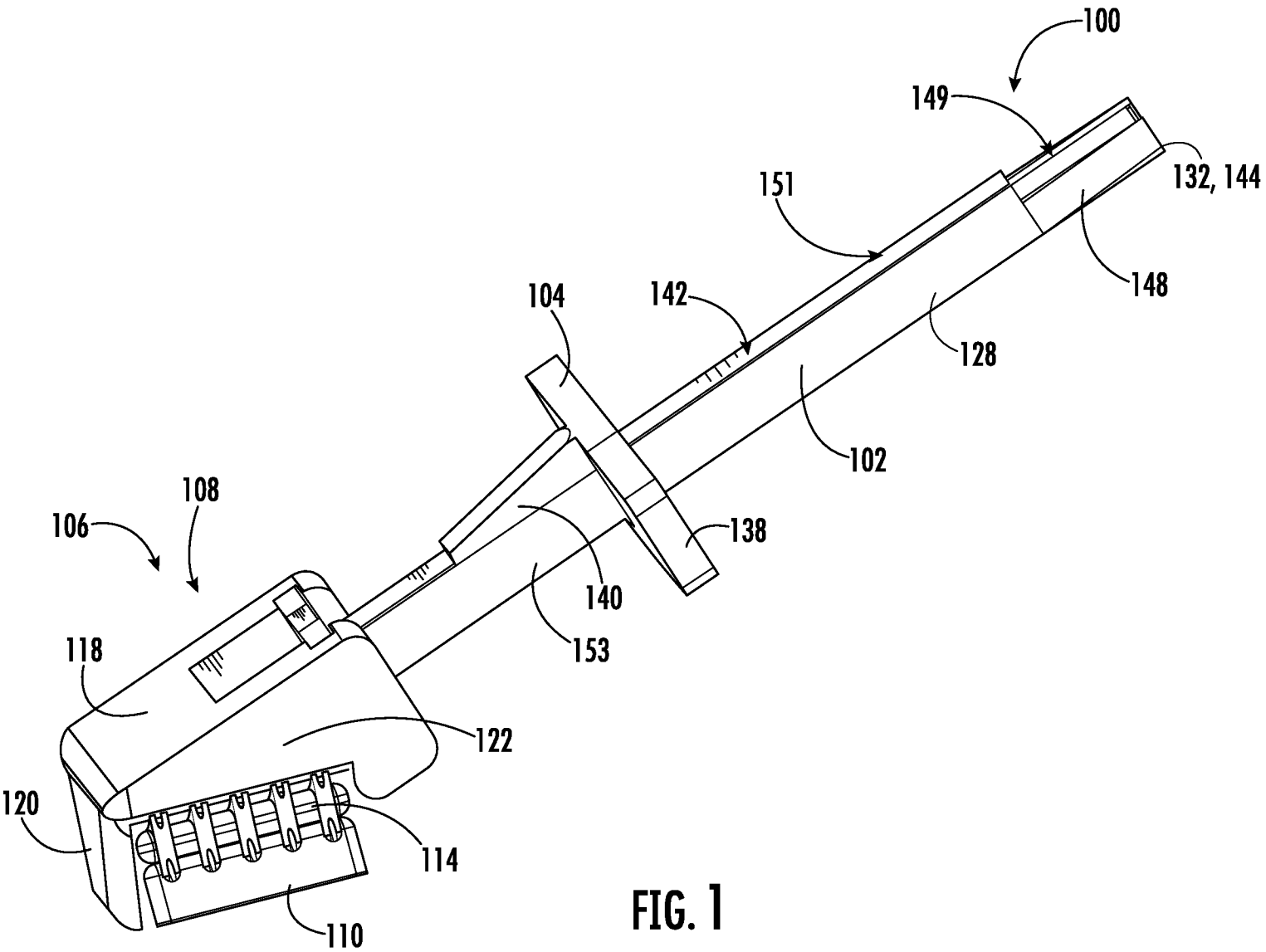
FIG. 1 illustrates a perspective view of a loader assembly in accordance with embodiments of the present disclosure.

Reference now will be made in detail to embodiments of the present clamping assemblies and loader assemblies, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Figure 2:
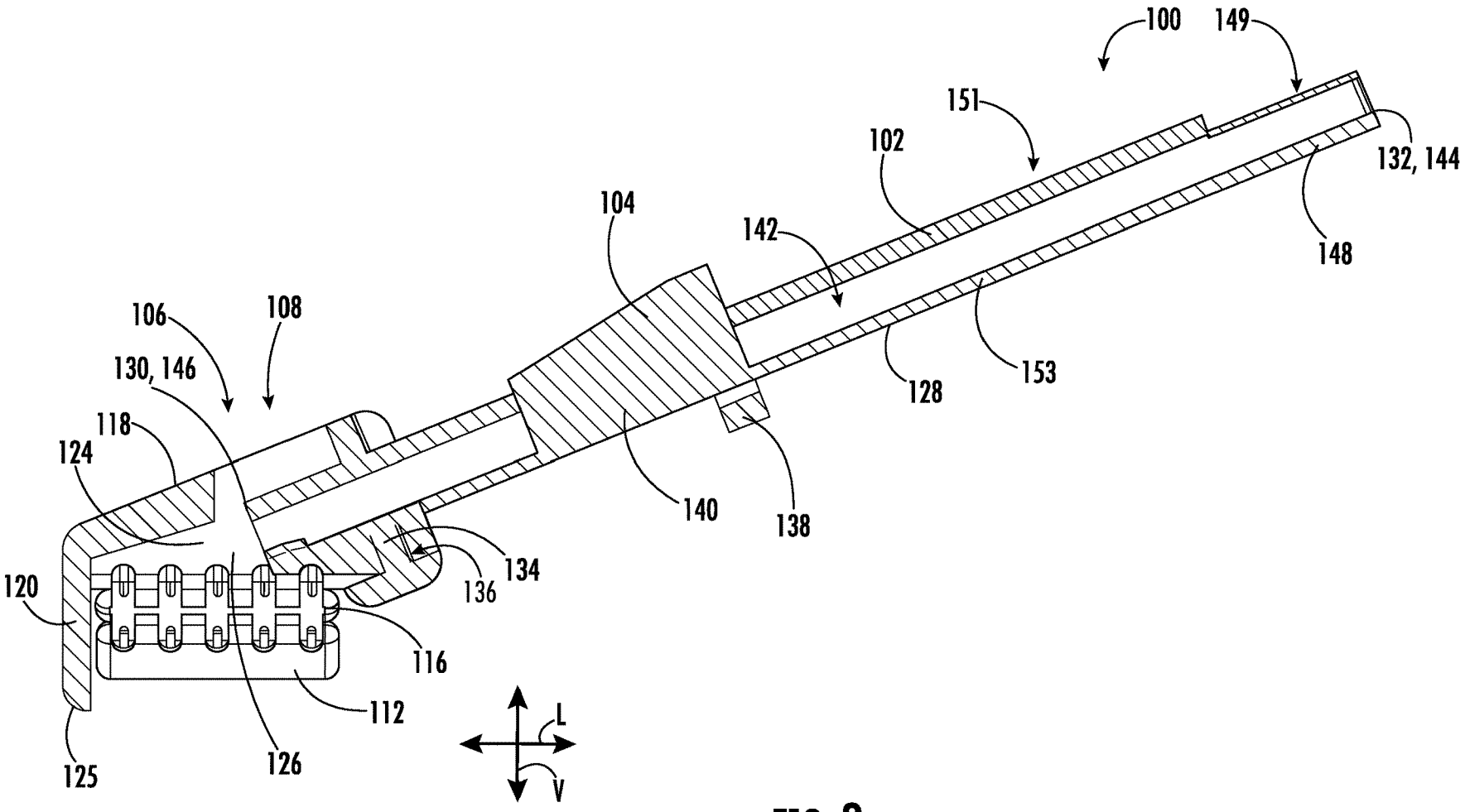
FIG. 2 illustrates a cross sectional view of the loader assembly of FIG. 1 in accordance with embodiments of the present disclosure.
Figure 3:
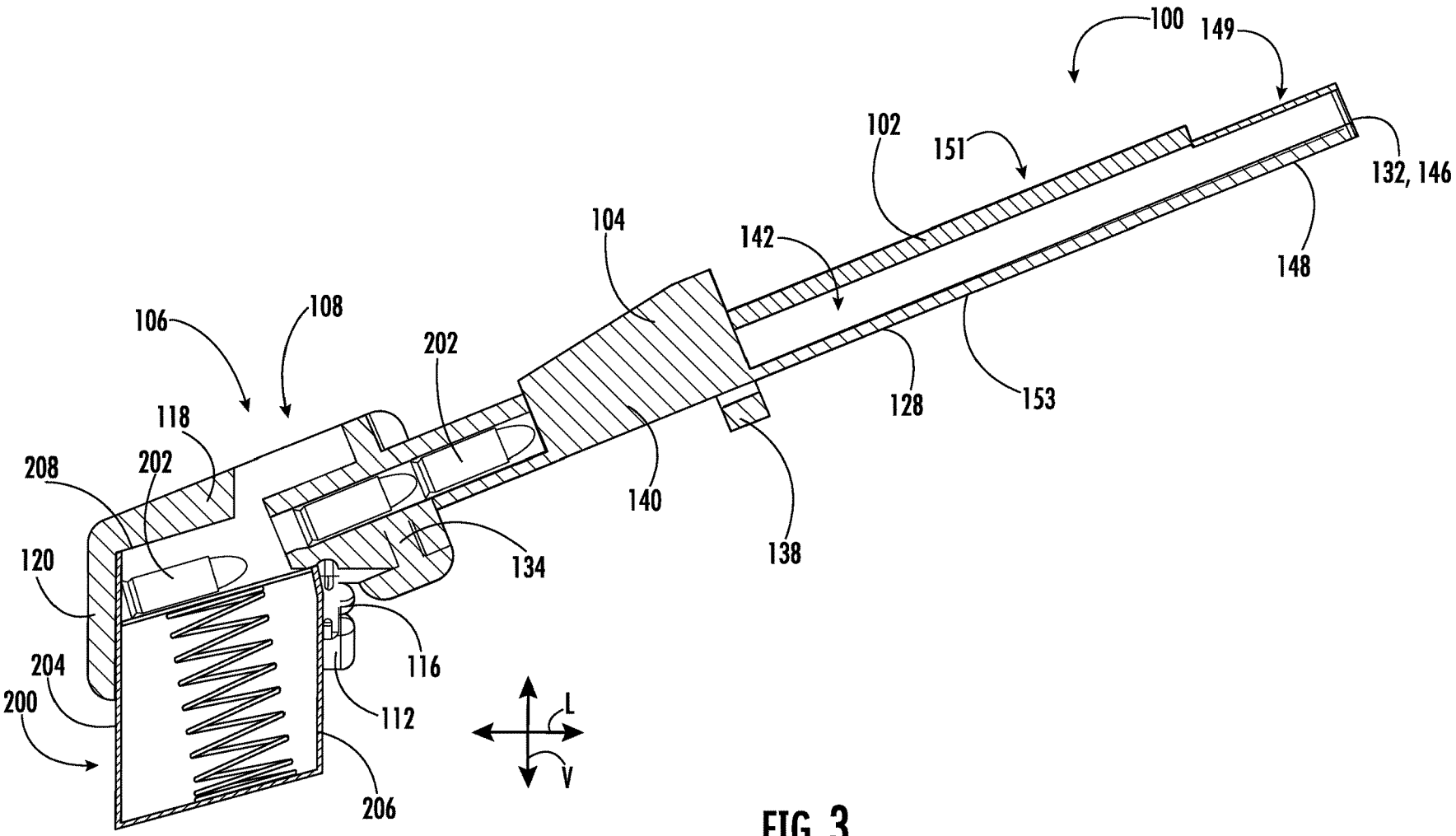
FIG. 3 illustrates a cross sectional view of the loader assembly of FIG. 1 coupled to a firearm magazine in accordance with embodiments of the present disclosure.

Referring now to the drawings, FIGS. 1 through 3 illustrate various views of a loader assembly 100 in accordance with embodiments of the present disclosure. Particularly, FIG. 1 illustrates a perspective view of the loader assembly 100. FIG. 2 illustrates a cross-sectional view of the loader assembly 100. Additionally, FIG. 3 illustrates a cross-sectional view of the loader assembly 100 coupled to a firearm magazine 200. The loader assembly 100 may facilitate the loading of a cartridge 202 (or bullets) into the firearm magazine 200, such as a pistol magazine, rifle magazine, or other magazine. For example, the loader assembly 100 may advantageously provide additional leverage for a user to easily load the cartridges 202 into the firearm magazine 200 with minimal effort by the user.

As shown in FIGS. 2 and 3, the loader assembly 100 may define a Cartesian (or rectangular) coordinate system having a longitudinal direction L, a vertical direction V, and a transverse direction (not shown, but extending into and out of the page in FIGS. 2 and 3).

In exemplary embodiments, as shown, the loader assembly 100 may include a cartridge member 102, a plunger member 104, and a clamping assembly 106. The clamping assembly 106 may be removably couplable to the cartridge member 102, and the plunger member 104 may be slidably couplable with the cartridge member 102.

The clamping assembly 106 may include a main frame 108, a first side plate 110, a second side plate 112, a first connection plate 114, and a second connection plate 116. The main frame 108 may include a top portion 118, a back stop portion 120, a first side portion 122, and a second side portion 124. The back stop portion 120 may extend (e.g., generally vertically) from the top portion 118 of the main frame 108 to a terminal end 125 (FIG. 2). The first side portion 122 and the second side portion 124 may be spaced apart from one another and each extend generally perpendicularly from the back stop portion 120. The top portion 118 of the main frame 108 may extend from back stop portion 120 at an angle relative to the vertical direction V and/or the longitudinal direction L. The side portions 122, 124 may extend (e.g., generally vertically and longitudinally) from the top portion 118. The main frame 108 may define a cavity 126 collectively by the top portion 118, the back stop portion 120, the first side portion 122, and the second side portion 124.

As shown in FIG. 3, the firearm magazine 200 may include a top wall 208, a back wall 204, front wall 206, and side walls (not shown) extending between the back wall 204 and the front wall 206. In operation, as shown in FIG. 3, the firearm magazine 200 may be inserted into the cavity 126 of the main frame 108 until the back wall 204 of the firearm magazine 200 is be forced against the back stop portion 120, and the top wall 208 is forced against the top portion 118, in order to align the firearm magazine 200 within the clamping assembly 106. Additionally, the side portions 122, 124 may each be positioned adjacent to (and/or in contact with) the side walls of the firearm magazine 200 (not shown).

Referring still to FIGS. 1 through 3, the cartridge member 102 may be removably couplable with the clamping assembly 106. For example, the cartridge member 102 include a tube body 128 and a connection block 134 extending from the tube body 128. The tube body 128 may extend from a connection end 130 to a free end 132. The connection end 130 of the tube cartridge member 128 may be positioned within the cavity 126 of the main frame 108. The free end 132 may be disconnected from any other components. The connection block 134 may extend from the tube cartridge member 128 proximate the connection end 130 (i.e., closer to the connection end 130 than the free end 132). In the embodiment shown, the connection block 134 may be generally shaped as a rectangular prism (which advantageously prevents rotation of the clamping assembly 106 relative to the tube cartridge member 128); however, it should be appreciated that other shapes are within the scope and spirit of the present disclosure. Additionally, as shown best in FIG. 2, the main frame 108 may define a slot 136 having a shape that corresponds with an exterior shape of the connection block 134, such that the connection block 134 may be slidably coupled to the main frame 108 via the slot 136. In other words, the connection block 134 may be slidably couplable to the main frame 108 via the slot 136 defined in the main frame 108.

The tube body 128 of the cartridge member 102 may define a cartridge slot 142 that is sized to receive a plurality of cartridges 202 (FIG. 3). The cartridge slot 142 may extend from an inlet 144 at the free end 132 to an outlet 146 at the connection end 130. In many embodiments, the tube body 128 may include an inlet segment 148 and a guide segment 153. The inlet segment 148 may extend from the free end 132 to the guide segment 153, and the guide segment 153 may extend from the inlet segment 148 to the connection end 130. The inlet segment 148 may be shaped as a hollow half cylinder, which allows for cartridges 202 to be easily inserted into the guide segment 153. In other words, the inlet segment 148 includes an open top 149 sized to receive the cartridges 202. The guide segment 153 may have a semi-closed top 151 that prevents the cartridges 202 from falling out of the cartridge slot 142 while still allowing for slidable movement of the plunger member 104.

The plunger member 104 may be movably coupled to the cartridge member 102. In many embodiments, the plunger member 104 may include a press portion 138 and a slider portion 140. The slider portion 140 may extend generally perpendicularly from the press portion 138. The slider portion 140 may be insertable into (and movable within) the cartridge slot 142. In this way, a user may apply a force to the press portion 138 to slide the slider portion 140 within the cartridge slot 142. During operation, the slider portion 140 may contact a cartridge 202, and a user may apply a force to the press portion 138 to load cartridges 202 into the firearm magazine 200.

Figure 4:
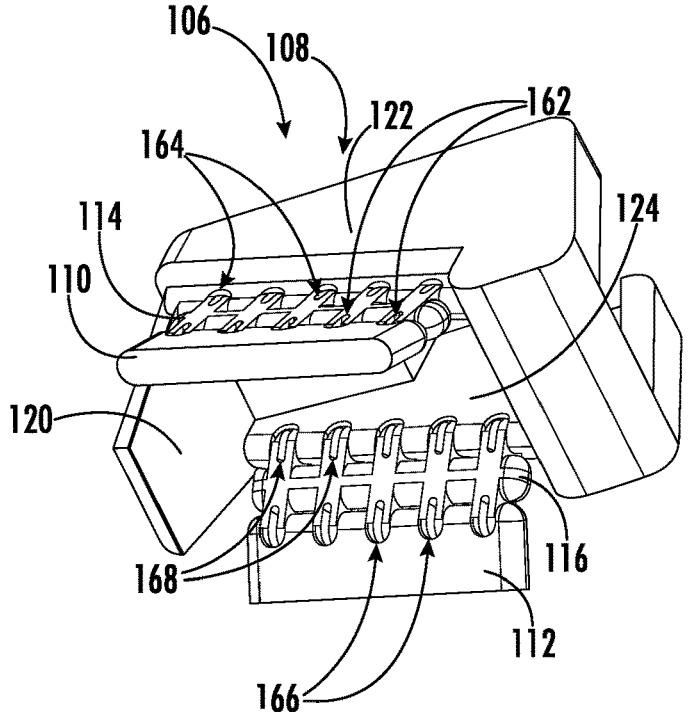
FIG. 4 illustrates a perspective view of a clamping assembly in accordance with embodiments of the present disclosure.
Figure 5:
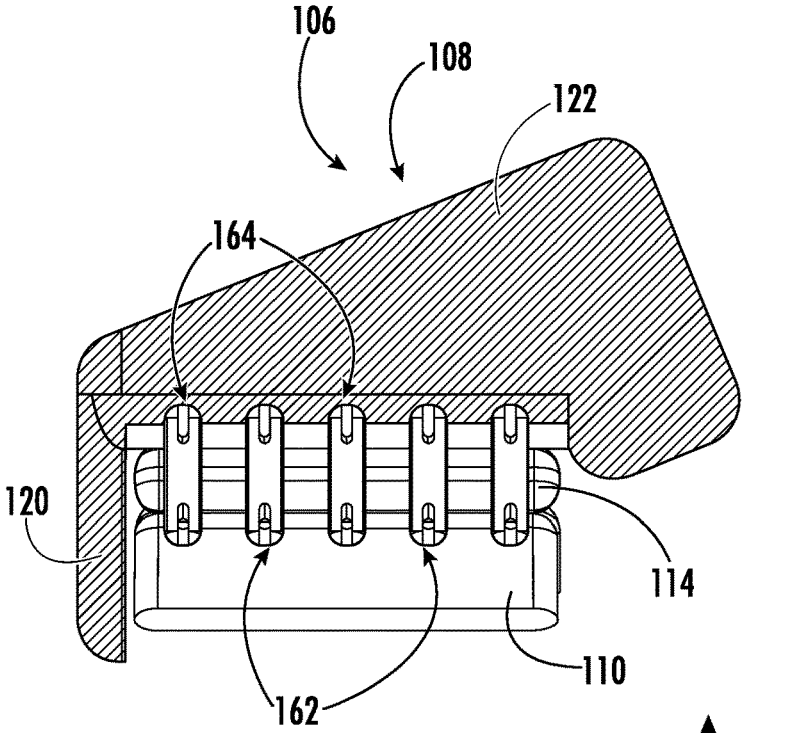
FIG. 5 illustrates a cross sectional view of the clamping assembly of FIG. 5 in accordance with embodiments of the present disclosure.
Figure 5:
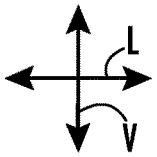

FIGS. 4 and 5 each illustrate the clamping assembly 106, which may be included in the loader assembly 100 discussed above with reference to FIGS. 1 through 3. The clamping assembly 106 may be configured to clutch a firearm magazine 200 during the loading of a cartridge 202 into the firearm magazine 200 (FIG. 3). The clamping assembly 106 may include the main frame 108, the first side plate 110, the second side plate 112, the first connection plate 114, and a second connection plate 116.

The first connection plate 114 may be disposed between the first side plate 110 and the first side portion 122 of the main frame 108. Further, the first connection plate 114 may pivotably couple to both the first side plate 110 and the first side portion 122 of the main frame 108. For example, the first connection plate 114 may be pivotably coupled to the to the first side portion 122 of the main frame 108 on a first side of the first connection plate 114, and the first connection plate 114 may be pivotably coupled to the first side plate 110 on a second side of the first connection plate 114. Similarly, the second connection plate 116 may be disposed between the second side plate 112 and the second side portion 124 of the main frame 108. Further, the second connection plate 116 may pivotably couple to both the second side plate 112 and the second side portion 124 of the main frame 108. For example, the second connection plate 116 may be pivotably coupled to the to the second side portion 124 of the main frame 108 on a first side of the second connection plate 116, and the second connection plate 116 may be pivotably coupled to the second side plate 112 on a second side of the second connection plate 116.

Still referring to FIGS. 4 and 5, a first ball and socket joint 162 may be defined between the first connection plate 114 and the first side plate 110. Particularly, the first ball and socket joint 162 may be one of a plurality of first ball and socket joints 162 spaced apart from one another, with each first ball and socket joint 162 pivotably coupling the first connection plate 114 to the first side plate 110. Additionally, a second ball and socket joint 164 may be defined between the first connection plate 114 and the main frame 108. The second ball and socket joint 164 may be one of a plurality of second ball and socket joints 164 spaced apart from one another, with each second ball and socket joint 164 pivotably coupling the first connection plate 114 to the main frame 108 (e.g., to the first side portion 122 of the main frame 108). Each of the first ball and socket joints 162 may be aligned with one another vertically and spaced apart longitudinally. Likewise, each of the second ball and socket joints 164 may be aligned with one another vertically and spaced apart longitudinally. Alignment of the first ball and socket joints (162) and the second ball and socket joints (164) may be vertical or staggered longitudinally.

Similarly, a third ball and socket joint 166 may be defined between the second connection plate 116 and the second side plate 112. Particularly, the third ball and socket joint 166 may be one of a plurality of third ball and socket joints 166 spaced apart from one another, with each third ball and socket joint 166 pivotably coupling the second connection plate 116 to the second side plate 112. Additionally, a fourth ball and socket joint 168 may be defined between the second connection plate 116 and the main frame 108. The fourth ball and socket joint 168 may be one of a plurality of fourth ball and socket joints 168 spaced apart from one another, with each fourth ball and socket joint 168 pivotably coupling the second connection plate 116 to the main frame 108 (e.g., to the second side portion 124 of the main frame 108). Each of the third ball and socket joints 166 may be aligned with one another vertically and spaced apart longitudinally. Likewise, each of the fourth ball and socket joints 168 may be aligned with one another vertically and spaced apart longitudinally.

Alignment of the third ball and socket joints (166) and the fourth ball and socket joints (168) may be vertical or staggered longitudinally.

Figure 6:
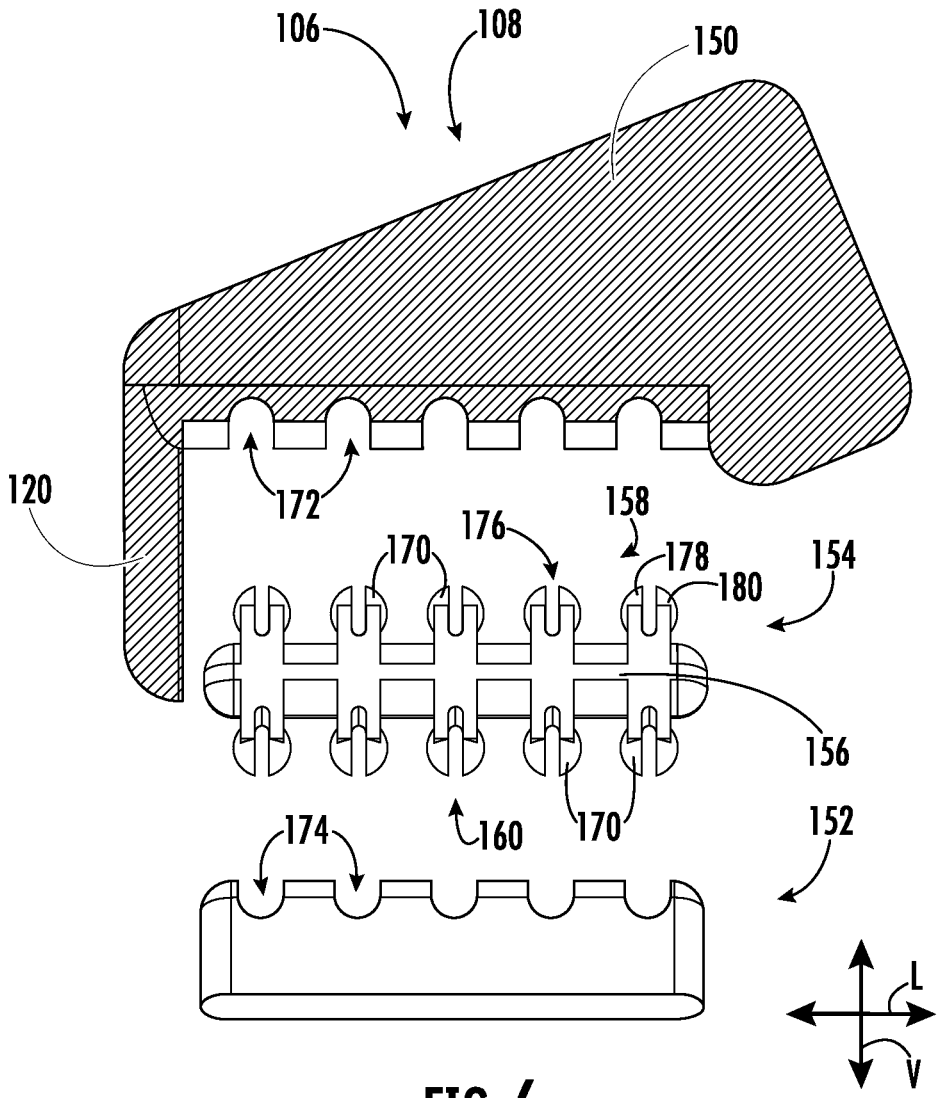
FIG. 6 illustrates an exploded view of the clamping assembly of FIG. 4 in accordance with embodiments of the present disclosure.

FIG. 6 illustrates an enlarged exploded view of the connection assembly 106 in accordance with exemplary aspects of the present disclosure. As shown, the connection assembly 106 may include a main frame 108 having a side portion 150 (which may be representative of either or both the first side portion 122 and/or the second side portion 124 discussed above with reference to FIGS. 1-5). Additionally, the connection assembly 106 may include a side plate 152 and a connection plate 154. The side plate 152 may be representative of either (or both) of the first side plate 112 and/or the second side plate 114 discussed above with reference to FIGS. 1-5. Similarly, the connection plate 154 may be representative of either (or both) the first connection plate 114 and/or the second connection plate 116 discussed above with reference to FIGS. 1-5.

As shown in FIG. 6, the connection plate 154 may include a main body 156, a first coupling feature 158, and a second coupling feature 160. The first coupling feature 158 and the second coupling feature 160 may each extend from the main body 156 in opposite directions. The first coupling feature 158 may be pivotably (and removably) couplable to the side portion 150, and the second coupling feature 160 may be pivotably (and removably) couplable to the side plate 152.

The first coupling feature 158 and the second coupling feature 160 may each be at least one of a ball 170 extending from the main body 156 or a socket defined in the main body 156. The ball and socket joint as described may also be non-spherical (ie. of a geometry suitable to allow rotation about a common axis). As a non-limiting example, the ball and socket connections along a common axis can be replaced with a piano hinge along the common axis. That is, in the illustrated embodiment, the first coupling feature 158 and the second coupling feature 160 are each balls 170 that extend from the main body 156, and the corresponding sockets 172, 174 are defined in the main frame 108 and the side plate 152. However, in other embodiments (not shown), the ball and socket arrangement may be reversed. In such an arrangement, the balls may extend from the main frame 108 and the side plate 152, and the sockets may be defined in the main frame 156.

As shown in FIG. 6, each of the balls 170 may define as slot 176, which may partition the ball 170 into a first portion 178 and a second portion 180 spaced apart from one another such that a gap is defined therebetween. The slot 176 may advantageously facilitate the removable coupling of the connection plate 154 to the sockets 172 in the main frame and the sockets 174 in the side plate 152.

During operation, a user may adjust a gap (e.g., a transverse gap) between the side plates 110, 112 and the connection plates 114, 116 by pivoting the side plates 110, 112 and the connection plates 114, 116 relative to each other and relative to the main frame. This advantageously allows for flexibility in the size firearm magazine to be clamped (or clutched) by the clamping assembly.

Figure 7:
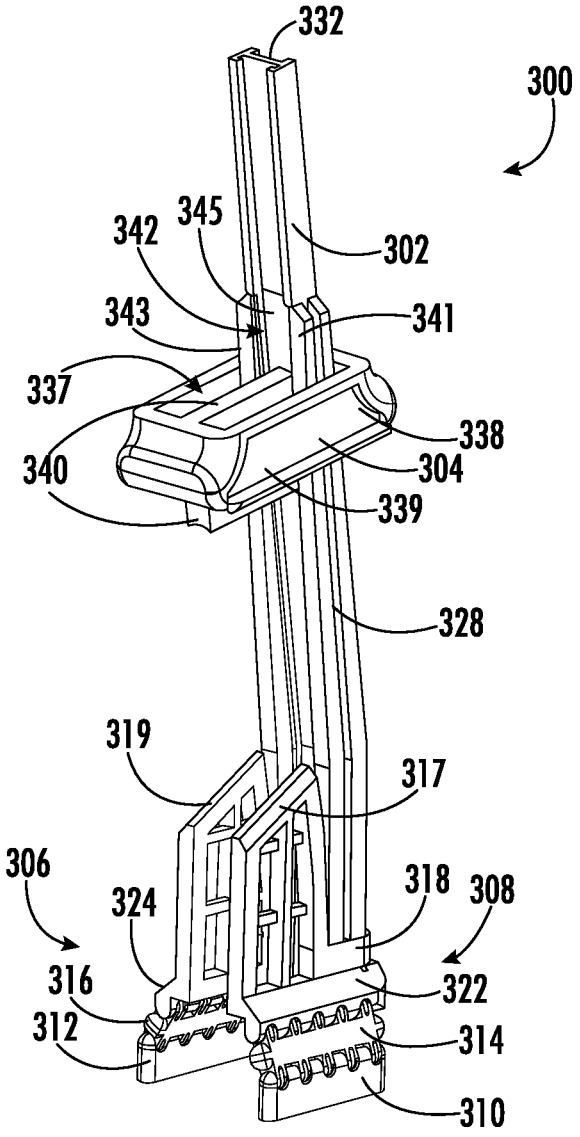
FIG. 7 illustrates a perspective view of a loader assembly in accordance with embodiments of the present disclosure.
Figure 8:
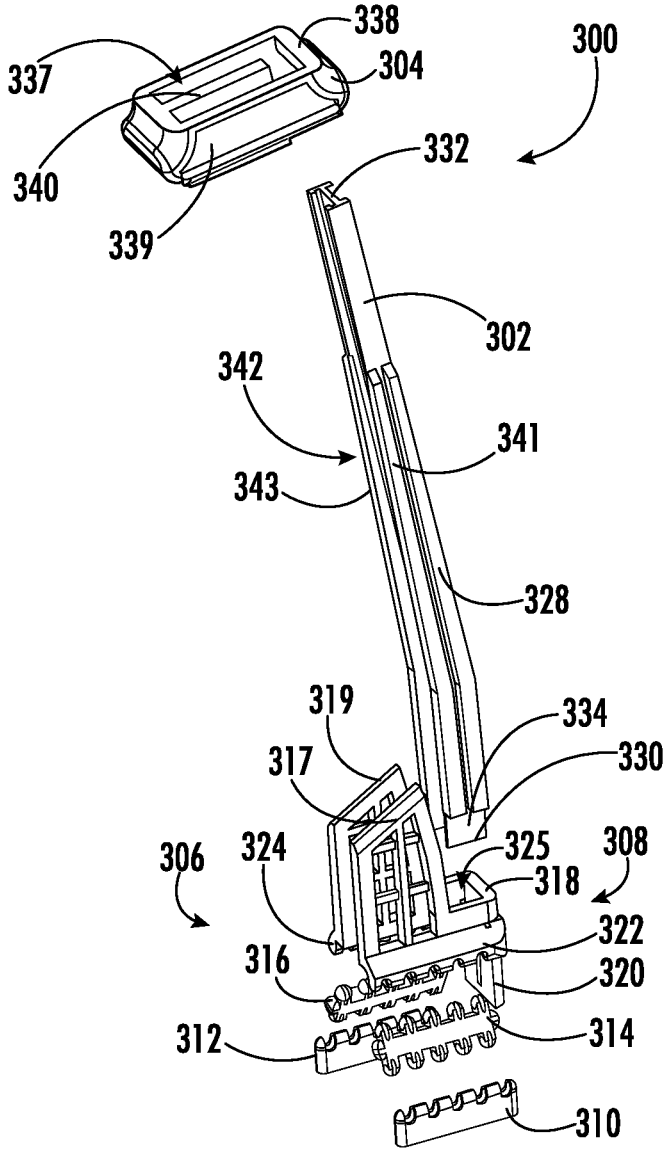
FIG. 8 illustrates an exploded view of the loader assembly of FIG. 7 in accordance with embodiments of the present disclosure.
Figure 9:
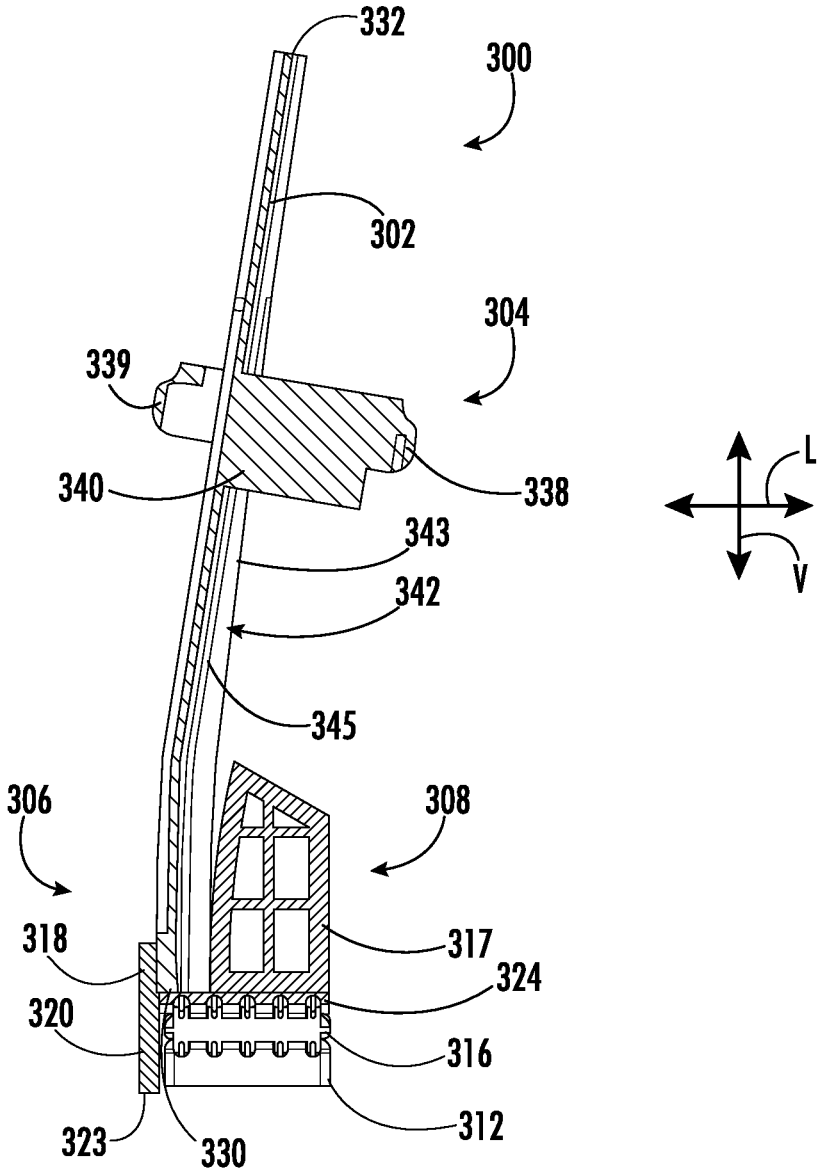
FIG. 9 illustrates a cross sectional view of the loader assembly of FIG. 7 in accordance with embodiments of the present disclosure.

Referring now to FIGS. 7 through 9, a loader assembly 300 is illustrated in accordance with embodiments of the present disclosure. Particularly, FIG. 7 illustrates a perspective view of the loader assembly 300. FIG. 8 illustrates an exploded view of the loader assembly 300. FIG. 9 illustrates a cross-sectional view of the loader assembly 300. The loader assembly 300 may facilitate the loading of a cartridge (or bullets) into the firearm magazine, such as a pistol magazine, rifle magazine, or other magazine. For example, the loader assembly 300 may advantageously provide additional leverage for a user to easily load the cartridges into the firearm magazine with minimal effort by the user.

As shown in FIGS. 9, the loader assembly 300 may define a Cartesian (or rectangular) coordinate system having a longitudinal direction L, a vertical direction V, and a transverse direction (not shown, but extending into and out of the page in FIG. 9).

In exemplary embodiments, as shown, the loader assembly 300 may include a cartridge member 302, a plunger member 304, and a clamping assembly 306. The clamping assembly 306 may be removably couplable to the cartridge member 302, and the plunger member 304 may be slidably couplable with the cartridge member 302.

The clamping assembly 306 may include a main frame 308, a first side plate 310, a second side plate 312, a first connection plate 314, and a second connection plate 316. The main frame 308 may include a top portion 318, a back stop portion 320, a first side portion 322, a second side portion 324, a first wing portion 317, and a second wing portion 319. The first wing portion 317 may extend from the first side portion 322 away from the first connection plate 314, and the second wing portion 319 may extend from the second side portion 324 away from the second connection plate 316. The wing portions 317, 319 may define a plurality of openings that advantageously reduce weight while maintaining structural integrity.

The back stop portion 320 may extend (e.g., generally vertically) from the top portion 318 of the main frame 308 to a terminal end 323 (FIG. 9). The first side portion 322 and the second side portion 324 may be spaced apart from one another and each extend generally perpendicularly from the back stop portion 320. The top portion 318 of the main frame 308 may extend from back stop portion 320 and the side portions 322, 324, and the top portion 318 may partially define an opening 325 into which the cartridge member 302 may be inserted. The side portions 322, 324 may extend (e.g., generally vertically and longitudinally) from the top portion 318.

During operation, the firearm magazine 200 may be inserted into the main frame 308 until a back wall of the firearm magazine is forced against the back stop portion 320. Subsequently, the user may adjust a gap (e.g., a transverse gap) between the side plates 310, 312 and the connection plates 314, 316 by pivoting the side plates 310, 312 and the connection plates 314, 316 relative to each other and relative to the main frame 308. This advantageously allows for flexibility in the size firearm magazine to be clamped (or clutched) by the clamping assembly 306.

Referring still to FIGS. 7 through 9, the cartridge member 302 may be removably couplable with the clamping assembly 306. For example, the cartridge member 302 include a body 328 and a connection block 334 extending from the body 326. The body 326 may extend from a connection end 330 to a free end 332. The connection end 330 of the cartridge member 302 may be positioned within the main frame 308. The free end 332 may be disconnected from any other components. The connection block 334 may extend from the body 328 to the connection end 330. Additionally, as shown best in FIG. 8, the main frame 308 may define an opening 325 having a shape that corresponds with an exterior shape of the connection block 334, such that the connection block 334 may be slidably coupled to the main frame 308 via the opening 325.

The body 328 of the cartridge member 302 may include a first side bar 341 a second side bar 343, and a web 345 extending between the first side bar 341 and the second side bar 343. A cartridge slot 342 that is sized to receive a plurality of cartridges may be defined by the first side bar 341, the second side bar 343, and the web 345. The cartridge slot 342 may extend from an inlet at the free end 332 to an outlet at the connection end 330.

The plunger member 304 may be movably coupleable to the cartridge member 302. In many embodiments, the plunger member 304 may include a press portion 338 and a slider portion 340. The press portion 338 may include an annular body 339 that defines a cavity 337. The slider portion 340 may extend generally perpendicularly from the annular body 339 of the press portion 338 into the cavity 337. The slider portion 340 may be insertable into (and movable within) the cartridge slot 342. For example, the annular body 339 may surround the cartridge member 302, and the slider portion 340 may extend into the slot 342 to restrict movement of the plunger member 304 along the slot 342. In this way, a user may apply a force to the press portion 338 to slide the slider portion 340 within the cartridge slot 342. During operation, the slider portion 340 may contact a cartridge, and a user may apply a force to the press portion 338 to move the plunger member 304 within the slot 342 and load cartridges into the firearm magazine.

Figure 11:
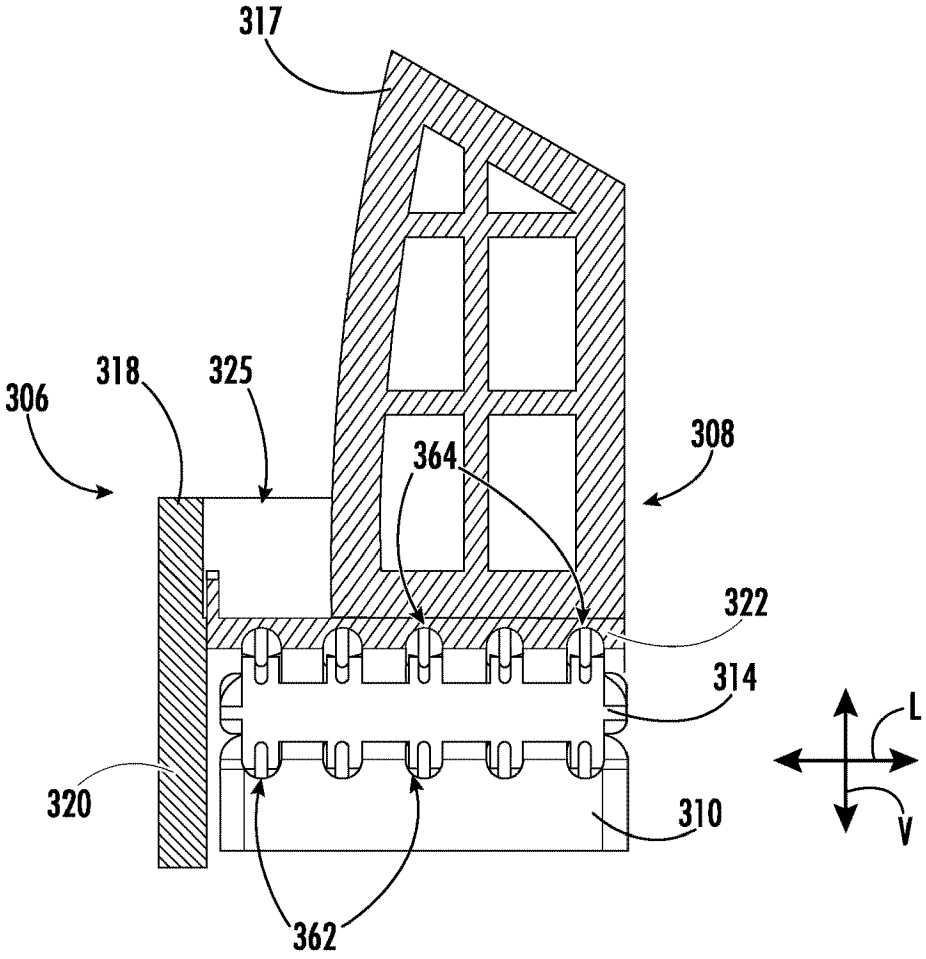
FIG. 11 illustrates a cross sectional view of the clamping assembly of FIG. 10 in accordance with embodiments of the present disclosure.
Figure 10:
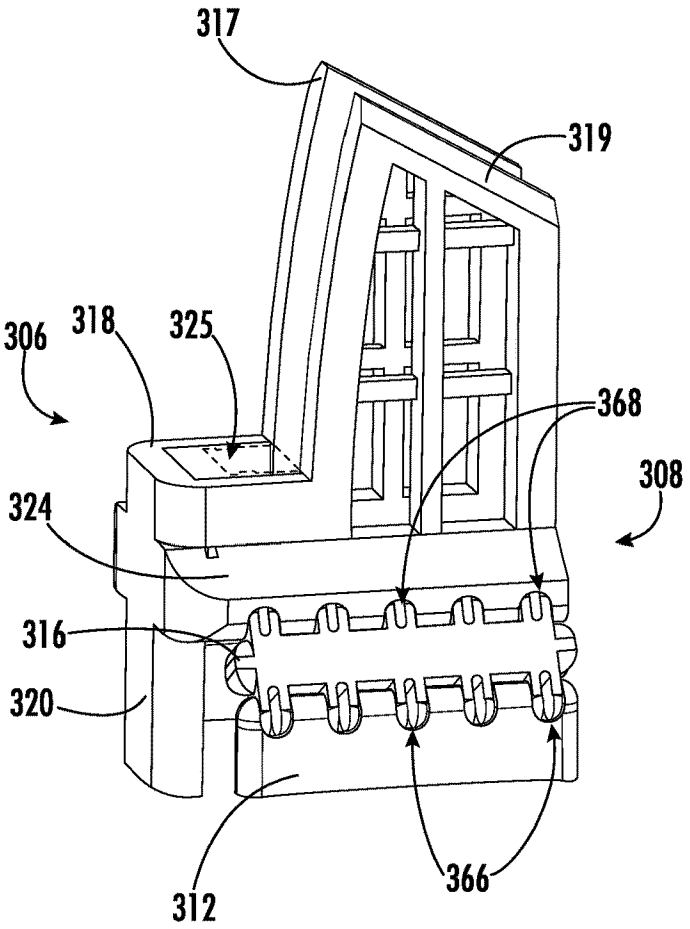
FIG. 10 illustrates a perspective view of a clamping assembly in accordance with embodiments of the present disclosure.

FIGS. 10 and 11 each illustrate the clamping assembly 306, which may be included in the loader assembly 300 discussed above with reference to FIGS. 6 through 9. The clamping assembly 306 may be configured to clutch a firearm magazine during the loading of a cartridge into the firearm magazine. The clamping assembly 306 may include the main frame 308, the first side plate 310, the second side plate 312, the first connection plate 314, and a second connection plate 316.

The first connection plate 314 may be disposed between the first side plate 310 and the first side portion 322 of the main frame 308. Further, the first connection plate 314 may pivotably couple to both the first side plate 310 and the first side portion 322 of the main frame 308. For example, the first connection plate 314 may be pivotably coupled to the to the first side portion 322 of the main frame 308 on a first side of the first connection plate 314, and the first connection plate 314 may be pivotably coupled to the first side plate 310 on a second side of the first connection plate 314. Similarly, the second connection plate 316 may be disposed between the second side plate 312 and the second side portion 324 of the main frame 308. Further, the second connection plate 316 may pivotably couple to both the second side plate 312 and the second side portion 324 of the main frame 308. For example, the second connection plate 316 may be pivotably coupled to the to the second side portion 324 of the main frame 308 on a first side of the second connection plate 316, and the second connection plate 316 may be pivotably coupled to the second side plate 312 on a second side of the second connection plate 316.

Still referring to FIGS. 10 and 11, a first ball and socket joint 362 may be defined between the first connection plate 314 and the first side plate 310. Particularly, the first ball and socket joint 362 may be one of a plurality of first ball and socket joints 362 spaced apart from one another, with each first ball and socket joint 362 pivotably coupling the first connection plate 314 to the first side plate 310. Additionally, a second ball and socket joint 364 may be defined between the first connection plate 314 and the main frame 308. The second ball and socket joint 364 may be one of a plurality of second ball and socket joints 364 spaced apart from one another, with each second ball and socket joint 364 pivotably coupling the first connection plate 314 to the main frame 308 (e.g., to the first side portion 322 of the main frame 308). Each of the first ball and socket joints 362 may be aligned with one another vertically and spaced apart longitudinally. Likewise, each of the second ball and socket joints 364 may be aligned with one another vertically and spaced apart longitudinally. Alignment of the first ball and socket joints (362) and the second ball and socket joints (364) may be vertical or staggered longitudinally.

Similarly, a third ball and socket joint 366 may be defined between the second connection plate 316 and the second side plate 312. Particularly, the third ball and socket joint 366 may be one of a plurality of third ball and socket joints 366 spaced apart from one another, with each third ball and socket joint 366 pivotably coupling the second connection plate 316 to the second side plate 312. Additionally, a fourth ball and socket joint 368 may be defined between the second connection plate 316 and the main frame 308. The fourth ball and socket joint 368 may be one of a plurality of fourth ball and socket joints 368 spaced apart from one another, with each fourth ball and socket joint 368 pivotably coupling the second connection plate 316 to the main frame 308 (e.g., to the second side portion 324 of the main frame 308). Each of the third ball and socket joints 366 may be aligned with one another vertically and spaced apart longitudinally. Likewise, each of the fourth ball and socket joints 368 may be aligned with one another vertically and spaced apart longitudinally. Alignment of the third ball and socket joints (366) and the fourth ball and socket joints (368) may be vertical or staggered longitudinally.

Figure 12:
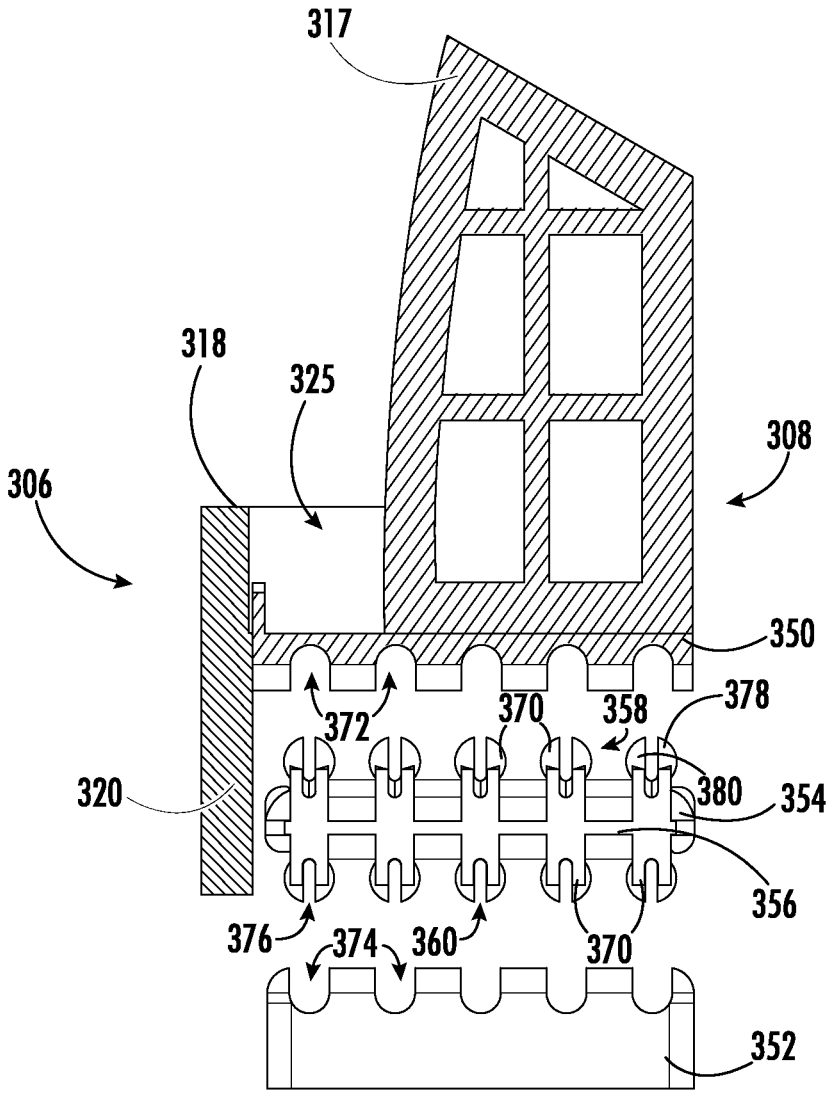
FIG. 12 illustrates a cross sectional exploded view of the clamping assembly of FIG. 10 in accordance with embodiments of the present disclosure.

FIG. 12 illustrates an enlarged exploded view of the connection assembly 306 in accordance with exemplary aspects of the present disclosure. As shown, the connection assembly 306 may include a main frame 308 having a side portion 350 (which may be representative of either or both the first side portion 322 and/or the second side portion 324 discussed above with reference to FIGS. 7-11). Additionally, the connection assembly 306 may include a side plate 352 and a connection plate 354. The side plate 352 may be representative of either (or both) of the first side plate 312 and/or the second side plate 314 discussed above with reference to FIGS. 7-11. Similarly, the connection plate 354 may be representative of either (or both) the first connection plate 314 and/or the second connection plate 316 discussed above with reference to FIGS. 7-11.

As shown in FIG. 12, the connection plate 354 may include a main body 356, a first coupling feature 358, and a second coupling feature 360. The first coupling feature 358 and the second coupling feature 360 may each extend from the main body 356 in opposite directions. The first coupling feature 358 may be pivotably (and removably) couplable to the side portion 350, and the second coupling feature 360 may be pivotably (and removably) couplable to the side plate 352.

The first coupling feature 358 and/or the second coupling feature 360 may each be at least one of a ball 370 extending from the main body 356 or a socket defined in the main body 356. In the illustrated embodiment, the first coupling feature 358 and the second coupling feature 360 are each balls 370 that extend from the main body 356, and the corresponding sockets 372, 374 are defined in the main frame 308 and the side plate 352. However, in other embodiments (not shown), the ball and socket arrangement may be reversed. In such an arrangement, the balls may extend from the main frame 308 and the side plate 352, and the sockets may be defined in the main frame 356. The ball and socket joint as described may also be non-spherical (ie. of a geometry suitable to allow rotation about a common axis). As a non-limiting example, the ball and socket connections along a common axis can be replaced with a piano hinge along the common axis.

As shown in FIG. 12, each of the balls 370 may define as slot 376, which may partition the ball 370 into a first portion 378 and a second portion 380 apart from one another such that a gap is defined therebetween. The slot 376 may advantageously facilitate the removable coupling of the connection plate 354 to the sockets 372 in the main frame and the sockets 374 in the side plate 352.

Figure 13:
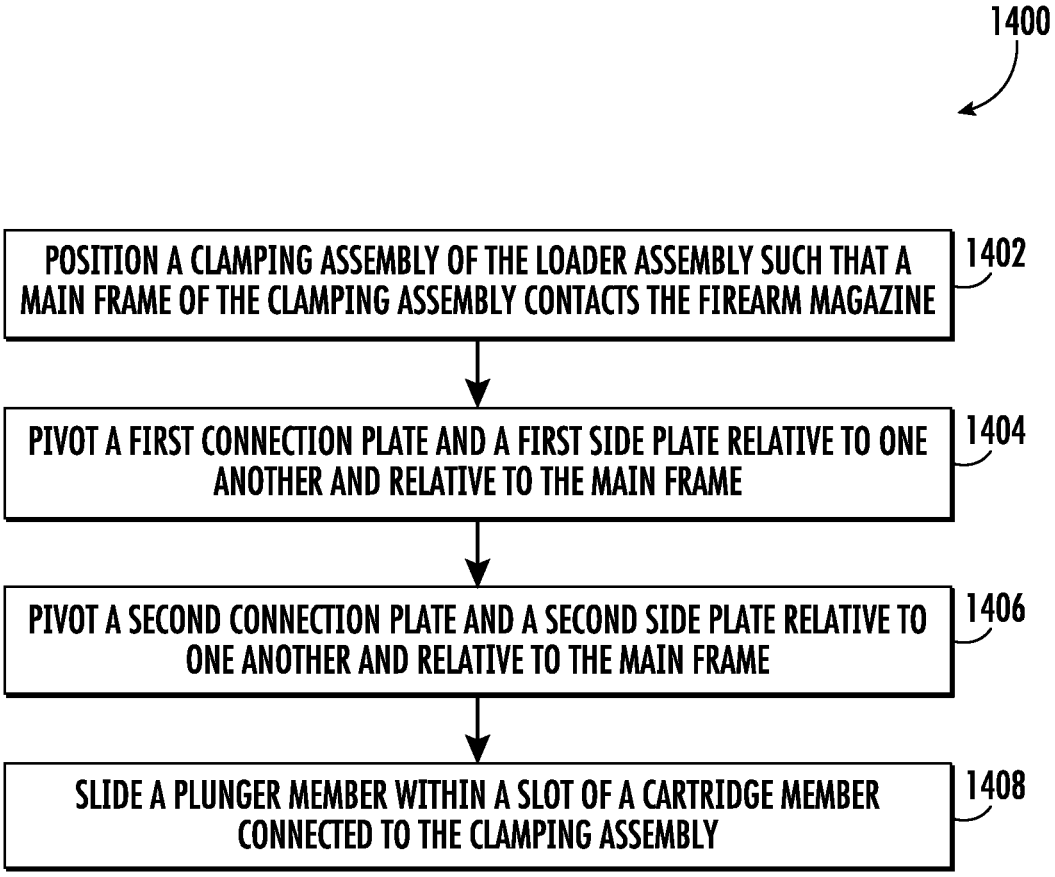
FIG. 13 illustrates a flow chart of a method of using a loader assembly to facilitate loading a cartridge into a firearm magazine in accordance with embodiments of the present disclosure.

Referring now to FIG. 13, a flow diagram of one embodiment of a method 1400 of using a loader assembly to facilitate loading a cartridge into a firearm magazine is illustrated in accordance with embodiments of the present subject matter. In general, the method 1400 will be described herein with reference to the system loader assemblies 100 and 300 described above with reference to FIGS. 1-12. However, it will be appreciated by those of ordinary skill in the art that the disclosed method 1400 may generally be utilized with any suitable assembly. In addition, although FIG. 13 depicts steps performed in a particular order for purposes of illustration and discussion, the methods discussed herein are not limited to any particular order or arrangement unless otherwise specified in the claims. One skilled in the art, using the disclosures provided herein, will appreciate that various steps of the methods disclosed herein can be omitted, rearranged, combined, and/or adapted in various ways without deviating from the scope of the present disclosure.

As shown, the method 1400 may include loading cartridges onto a cartridge member, and can further include sliding a plunger member onto an end of the cartridge member. Method 1400 may further include at (1402) positioning a clamping assembly of the loader assembly such that a main frame of the clamping assembly contacts the firearm magazine. For example, the firearm magazine may be positioned within a main frame of the clamping assembly between the first side plate and the second side plate. The method may further include at (1404) pivoting a first connection plate and a first side plate relative to one another and relative to the main frame. Additionally, the method 1400 may include at (1406) pivoting a second connection plate and a second side plate relative to one another and relative to the main frame. Particularly, wherein first connection plate, the first side plate, the second connection plate, and the second side plate are pivoted until the first side plate and the second side plate contact side walls of the firearm magazine, thereby clutching the firearm magazine within the clamping assembly. This advantageously prevents movement of the firearm magazine within the main frame when loading the cartridges, and can center the magazine in the main frame. Finally, the method 1400 may further include at (1408) sliding a plunger member within a slot of a cartridge member connected to the clamping assembly. The plunger member may contact the cartridge within the slot and be forced along the slot by the plunger member into the firearm magazine.

Further aspects of the invention are provided by the subject matter of the following clauses:

A clamping assembly for clutching a firearm magazine during loading of a cartridge into the firearm magazine. The clamping assembly includes a main frame having a back stop portion, a first side portion, and a second side portion; a first side plate; and a second side plate. The clamping assembly further includes a first connection plate disposed between the first side plate and the first side portion of the main frame and pivotably coupled to both the main frame and the first side plate. The clamping assembly further includes a second connection plate disposed between the second side plate and second side portion of the main frame and pivotably coupled to both the main frame and the second side plate.

A loader assembly that facilitates loading a cartridge into a firearm magazine. The loader assembly includes a cartridge member defining a cartridge slot that is sized to receive a plurality of cartridges; a plunger member movably coupled to the cartridge member; and a clamping assembly removably couplable to the cartridge member. The clamping assembly includes a main frame having a back stop portion, a first side portion, and a second side portion; a first side plate; and a second side plate. The clamping assembly further includes a first connection plate disposed between the first side plate and the first side portion of the main frame and pivotably coupled to both the main frame and the first side plate. The clamping assembly further includes a second connection plate disposed between the second side plate and second side portion of the main frame and pivotably coupled to both the main frame and the second side plate.

A method of using a loader assembly to facilitate loading a cartridge into a firearm magazine. The method includes positioning a clamping assembly of the loader assembly such that a main frame of the clamping assembly contacts the firearm magazine. The method further includes pivoting a first connection plate and a first side plate relative to one another and relative to the main frame; and pivoting a second connection plate and a second side plate relative to one another and relative to the main frame. The method further includes sliding a plunger member within a slot of a cartridge member connected to the clamping assembly, the plunger member contacting the cartridge within the slot.

A clamping assembly, loader assembly, or method in accordance with one or more embodiments disclosed herein, wherein at least one of the first connection plate or the second connection plate includes a main body; a first coupling feature on a first side of the main body; and a second coupling feature on a second side of the main body.

A clamping assembly, loader assembly, or method in accordance with one or more embodiments disclosed herein, wherein the first coupling feature and the second coupling feature are each at least one of a ball extending from the main body or a socket defined in the main body.

A clamping assembly, loader assembly, or method in accordance with one or more embodiments disclosed herein, wherein the ball defines a slot.

A clamping assembly, loader assembly, or method in accordance with one or more embodiments disclosed herein, wherein a first ball and socket joint is defined between the first connection plate and the first side plate, wherein a second ball and socket joint is defined between the first connection plate and the main frame, wherein a third ball and socket joint is defined between the second connection plate and the second side plate, and wherein a fourth ball and socket joint is defined between the second connection plate and the main frame.

A clamping assembly, loader assembly, or method in accordance with one or more embodiments disclosed herein, wherein the first ball and socket joint is one of a plurality of first ball and socket joints spaced apart from one another, wherein the second ball and socket joint is one of a plurality of second ball and socket joints spaced apart from one another, wherein the third ball and socket joint is one of a plurality of third ball and socket joints spaced apart from one another, and wherein the fourth ball and socket joint is one of a plurality of fourth ball and socket joints spaced apart from one another.

A clamping assembly, loader assembly, or method in accordance with one or more embodiments disclosed herein, wherein the first side portion and the second side portion are spaced apart from one another and each extend generally perpendicularly from the back stop portion.

A clamping assembly, loader assembly, or method in accordance with one or more embodiments disclosed herein, wherein the main frame further comprises a first wing portion and a second wing portion, the first wing portion extending from the first side portion away from the first connection plate, the second wing portion extending from the second side portion away from the second connection plate.

A clamping assembly, loader assembly, or method in accordance with one or more embodiments disclosed herein, wherein the cartridge member includes body and a connection block extending from the body, the connection block slidably couplable to the main frame via a slot defined in the main frame.

A clamping assembly, loader assembly, or method in accordance with one or more embodiments disclosed herein, wherein the first connection plate, the first side plate, the second connection plate, and the second side plate are pivoted until the first side plate and the second side plate contact side walls of the firearm magazine, thereby clutching the firearm magazine within the clamping assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A clamping assembly for clutching a firearm magazine during loading of a cartridge into the firearm magazine, the clamping assembly comprising:

a main frame having a back stop portion, a first side portion, and a second side portion;

a first side plate;

a second side plate;

a first connection plate disposed between the first side plate and the first side portion of the main frame and pivotably coupled to both the main frame and the first side plate; and a second connection plate disposed between the second side plate and second side portion of the main frame and pivotably coupled to both the main frame and the second side plate.

2. The clamping assembly as in claim 1, wherein at least one of the first connection plate or the second connection plate comprises:

a main body;

a first coupling feature on a first side of the main body; and a second coupling feature on a second side of the main body.

3. The clamping assembly as in claim 2, wherein the first coupling feature and the second coupling feature are each at least one of:

a ball extending from the main body; or a socket defined in the main body.

4. The clamping assembly as in claim 3, wherein the ball defines a slot.

5. The clamping assembly as in claim 1, wherein a first ball and socket joint is defined between the first connection plate and the first side plate, wherein a second ball and socket joint is defined between the first connection plate and the main frame, wherein a third ball and socket joint is defined between the second connection plate and the second side plate, and wherein a fourth ball and socket joint is defined between the second connection plate and the main frame.

6. The clamping assembly as in claim 5, wherein the first ball and socket joint is one of a plurality of first ball and socket joints spaced apart from one another, wherein the second ball and socket joint is one of a plurality of second ball and socket joints spaced apart from one another, wherein the third ball and socket joint is one of a plurality of third ball and socket joints spaced apart from one another, and wherein the fourth ball and socket joint is one of a plurality of fourth ball and socket joints spaced apart from one another.

7. The clamping assembly as in claim 1, wherein the first side portion and the second side portion are spaced apart from one another and each extend generally perpendicularly from the back stop portion.

8. The clamping assembly as in claim 1, wherein the main frame further comprises a first wing portion and a second wing portion, the first wing portion extending from the first side portion away from the first connection plate, the second wing portion extending from the second side portion away from the second connection plate.

9. A loader assembly that facilitates loading a cartridge into a firearm magazine, the loader assembly comprising:

a cartridge member defining a cartridge slot that is sized to receive a plurality of cartridges;

a plunger member movably coupled to the cartridge member; and a clamping assembly removably couplable to the cartridge member, the clamping assembly comprising:

a main frame having a back stop portion, a first side portion, and a second side portion;

a first side plate;

a second side plate;

a first connection plate disposed between the first side plate and the first side portion of the main frame and pivotably coupled to both the main frame and the first side plate; and a second connection plate disposed between the second side plate and second side portion of the main frame and pivotably coupled to both the main frame and the second side plate.

10. The loader assembly as in claim 9, wherein the cartridge member includes body and a connection block extending from the body, the connection block slidably couplable to the main frame via a slot defined in the main frame.

11. The loader assembly as in claim 9, wherein at least one of the first connection plate or the second connection plate comprises:

a main body;

a first coupling feature on a first side of the main body; and a second coupling feature on a second side of the main body.

12. The loader assembly as in claim 11, wherein the first coupling feature and the second coupling feature are each at least one of:

a ball extending from the main body; or a socket defined in the main body.

13. The loader assembly as in claim 12, wherein the ball defines a slot.

14. The loader assembly as in claim 9, wherein a first ball and socket joint is defined between the first connection plate and the first side plate, wherein a second ball and socket joint is defined between the first connection plate and the main frame, wherein a third ball and socket joint is defined between the second connection plate and the second side plate, and wherein a fourth ball and socket joint is defined between the second connection plate and the main frame.

15. The loader assembly as in claim 14, wherein the first ball and socket joint is one of a plurality of first ball and socket joints spaced apart from one another, wherein the second ball and socket joint is one of a plurality of second ball and socket joints spaced apart from one another, wherein the third ball and socket joint is one of a plurality of third ball and socket joints spaced apart from one another, and wherein the fourth ball and socket joint is one of a plurality of fourth ball and socket joints spaced apart from one another.

16. The loader assembly as in claim 9, wherein the first side portion and the second side portion are spaced apart from one another and each extend generally perpendicularly from the back stop portion.

17. The loader assembly as in claim 9, wherein the main frame further comprises a first wing portion and a second wing portion, the first wing portion extending from the first side portion away from the first connection plate, the second wing portion extending from the second side portion away from the second connection plate.

18. A method of using a loader assembly to facilitate loading a cartridge into a firearm magazine, the method comprising:

positioning a clamping assembly of the loader assembly such that a main frame of the clamping assembly contacts the firearm magazine;

pivoting a first connection plate and a first side plate relative to one another and relative to the main frame;

pivoting a second connection plate and a second side plate relative to one another and relative to the main frame;

sliding a plunger member within a slot of a cartridge member connected to the clamping assembly, the plunger member contacting the cartridge within the slot.

19. The method as in claim 18, wherein the first connection plate, the first side plate, the second connection plate, and the second side plate are pivoted until the first side plate and the second side plate contact side walls of the firearm magazine, thereby clutching the firearm magazine within the clamping assembly.

* * * * *